US005258269A

United States Patent [19]

Yagi et al.

[11] Patent Number: 5,258,269

[45] Date of Patent: Nov. 2, 1993

[54] SILVER HALIDE COLOR PHOTOGRAPHIC LIGHT SENSITIVE MATERIAL STORED IN ROLL AND THE PHOTOGRAPHIC UNIT THEREFOR

[75] Inventors: Toshihiko Yagi; Yoshiro Ito; Katsuhiko Heki, all of Hino, Japan

[73] Assignee: Konica Corporation, Tokyo, Japan

[21] Appl. No.: 725,986

[22] Filed: Jul. 5, 1991

[30] Foreign Application Priority Data

Jul. 9, 1990 [JP] Japan ..... 2-181053

[51] Int. Cl.[5] ..... G03C 3/02

[52] U.S. Cl. ..... 430/500; 430/501; 430/506; 430/963; 354/275; 206/408; 206/409; 206/389; 242/71.1

[58] Field of Search ..... 430/500, 501, 506, 963; 354/275; 206/408, 409, 389; 242/71.1

[56] References Cited

U.S. PATENT DOCUMENTS

| | | | |
|---|---|---|---|
| 4,827,298 | 5/1989 | Sasaki et al. | 354/288 |
| 4,866,469 | 9/1989 | Shiba et al. | 430/961 |
| 4,933,267 | 6/1990 | Ishigaki et al. | 430/501 |
| 5,004,675 | 4/1991 | Yoneyama et al. | 430/963 |
| 5,057,403 | 10/1991 | Kume et al. | 430/501 |
| 5,093,227 | 3/1992 | Nakazyo et al. | 430/963 |

FOREIGN PATENT DOCUMENTS

| | | |
|---|---|---|
| 2-62534 | 3/1990 | Japan . |
| 2-62535 | 3/1990 | Japan . |

OTHER PUBLICATIONS

Patent abstracts of Japan, vol. 12, No. 129(P-692)(2976); Apr. 21, 1988, JPA-62-253,148.

*Primary Examiner*—Charles L. Bowers, Jr.
*Assistant Examiner*—Thomas R. Neville
*Attorney, Agent, or Firm*—Jordan B. Bierman

[57] ABSTRACT

A light-sensitive silver halide color photographic material is disclosed. The color photographic material is stored in roll, and has a value of $$\frac{(\text{a roll diameter} - \text{a spool diameter})}{(\text{a number of turns} \times 2)} - \text{a thickness of the base film}$$

being 20 to 60 μm, wherein at least one silver halide emulsion layer contains a silver halide emulsion containing silver chrolide in a proportion of not less than 10 mol %. The photographic material is excellent in resistant to pressure desensitizing and preventive from producing scratching trouble. A photographic unit containing the photographic material is also disclosed.

10 Claims, 2 Drawing Sheets

SILVER HALIDE COLOR PHOTOGRAPHIC LIGHT SENSITIVE MATERIAL STORED IN ROLL AND THE PHOTOGRAPHIC UNIT THEREFOR

FIELD OF THE INVENTION

This invention relates to a silver halide color photographic light sensitive material and, particularly, to a silver halide color photographic light sensitive material stored in roll, which is excellent in pressure resistive characteristics and preventive of scratching troubles, and to the photographic unit therefor.

BACKGROUND OF THE INVENTION

With the advance of the miniaturization of photographic cameras, the freedom of designing cameras has been restricted by the diameters of roll-shaped silver halide light sensitive materials. In 1982, Eastman Kodak Company announced the so-called disk camera system for making use of a discoidal photographic film so as to solve the above-mentioned problem. When making use of this kind of discoidal photographic films, however, they have the defects such as that the sizes and numbers of taking pictures are limited and so forth. Therefore, the roll-shaped films have recently been getting reviewed.

Japanese Patent Publication Open to Public Inspection—hereinafter referred to as 'Japanese Patent O.P.I. Publication'— No. 1-224750/1989 discloses that a miniaturized and lightweight roll-shaped film can be provided by making the thickness of the support thereof to be within the range of 25 to 125 μm. Japanese Patent O.P.I. Publication No. 1-291248/1989 discloses a technique for solving a roll-set curling trouble that is a defect of the roll shaped films by replacing the film by a highly moisture-containing polyester film.

The studies on the minaturization of the roll-shaped films have been progressed on one hand and, at the same time, there have raised the problems on the other hand that a scratching trouble is produced by scratching the front side of a film with the rear side thereof or by scratching the film with a film cartridge or a camera body, when dragging out the film stored in roll after every shooting, and a pressure desensitization is produced when the film is made in the roll-shaped.

SUMMARY OF THE INVENTION

It is, therefore, an object of the invention is to provide a miniature-sized silver halide color photographic light sensitive material stored in roll, which is .excellent in pressure desensitization resistance and preventive from producing a scratching trouble, and to provide the photographic unit therefor.

A color photographic light sensitive material of the invention comprises a film base and a light sensitive silver halide emulsion layer which is stored in roll having a value of $$\frac{(\text{a roll diameter} - \text{a spool diameter})}{(\text{a number of turns} \times 2)} - \text{the thickness of a base} = 20 \text{ to } 60\ \mu\text{m},$$

wherein at least one out of the light sensitive silver halide emulsion layers contains a silver halide emulsion containing silver chloride in a proportion of not less than 10 mol%. The color photographic light sensitive material may compose a photographic unit having an exposure means. In this specification, the term, a 'roll diameter', means a outer diameter L of a film stored in roll.

DETAILED DESCRIPTION OF THE INVENTION

The silver halide color photographic light sensitive materials stored in roll are each to have a value of a $$\frac{(\text{a roll diameter} - \text{a spool diameter})}{(\text{a number of turns} \times 2)} - \text{the thickness of a base}$$

within the range of, desirably, 23 to 55 μm and, preferably, 25 to 50 μm.

The film base is desirably to have a thickness within the range of 25 to 120 μm and, preferably, 50 to 100 μm.

The raw materials for the films applicable thereto include, for example, the following semisynthetic or synthetic polymers:

Cellulose esters (including, particularly, triacetyl cellulose, cellulose diacetate, cellulose propionate, cellulose acetate propionate, cellulose butylate and cellulose acetate butylate), polyaimides, polycarbonates, polyesters (including, particularly, polyethylene terephthalate, poly-1,4-cyclohexanedimethylene terephthalate, polyethylene-1,2-diphenoxyethane-4,4'-dicarboxylate, polybutylene terephthalate, a copolymeric polyester comprising a copolymerizing component of an aromatic dicarboxylic acid having a polyethylene phthalate metal sulfonate, and a copolymeric polyester comprising a copolymerizing component of an aromatic dicarboxylic acid having a metal sulfonate and an aliphatic dicarboxylic acid), polystyrene, polypropylene, polyethylene, polymethyl pentene, polysulfone, polyether sulfone, polyallylate, an aromatic polyetherimide, an aromatic polyamide, an aromatic polyamidoimide, and polyphenylene sulfide.

Among them, triacetyl cellulose and polyethylene terephthalate are preferavely be applicable in particular.

In the invention, every roll-shaped film is not necessarily wound round a spool, but some of them may each have a space in the center of the roll. If this is the case, the term, a 'spool diameter' expressed in the invention is defined as a diameter of the space in the center of a roll.

The invention can be applied to a roll-shaped color photographic light sensitive material and a photographic unit having an exposure means.

In the invention, the term, "a photographic unit", means a unit having an exposure function, which is loaded therein in advance with an unexposed silver halide photographic light sensitive material.

Figure 1:
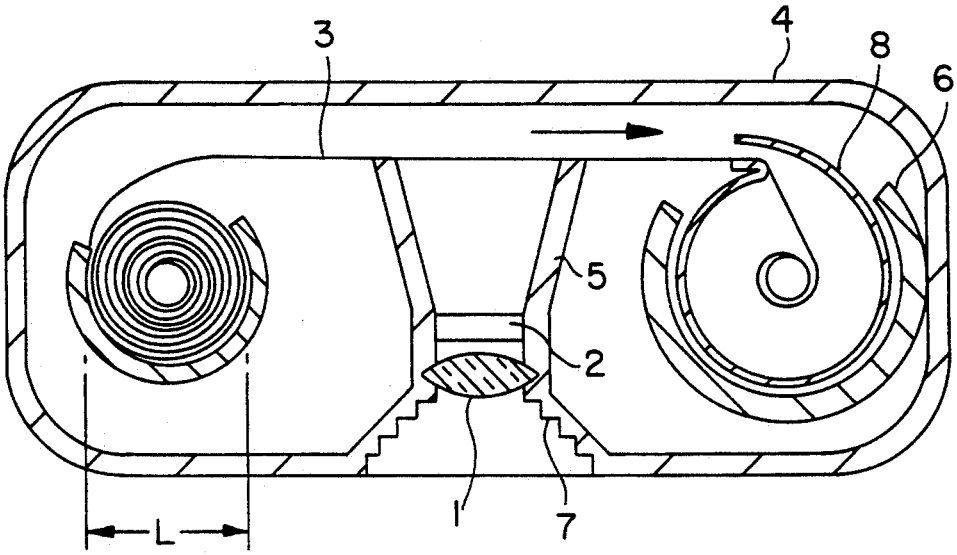
FIG. 1 is a cross-sectional view illustrating an example of the photographic units relating to the invention.
Figure 2:
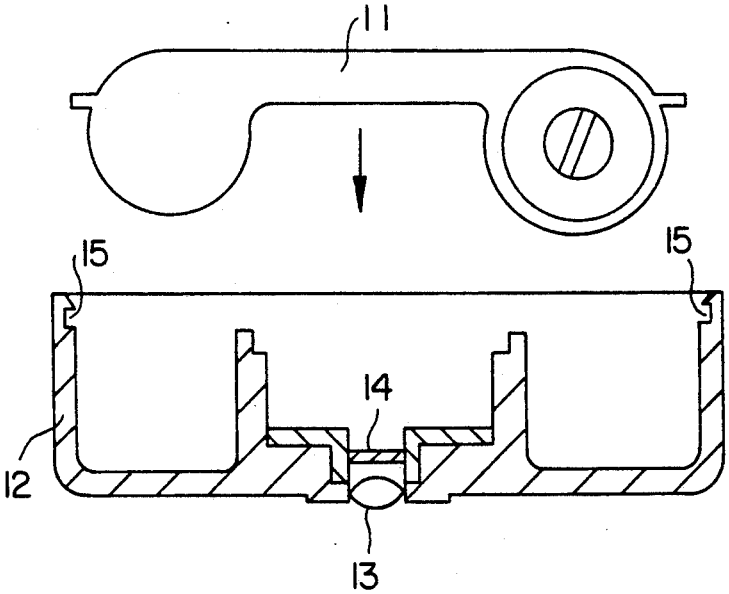
FIG. 2 is an illustration of a photographic unit comprising the cartridge of the invention and a unit body.

The photographic units of the invention include, for example, a so-called throwaway type unit typified by that shown in FIG. 1, which is destroyed so as to take out an exposed light sensitive material after completing photographic exposures, and a cartridge-replacing type unit typified by that shown in FIG. 2, which replaces one cartridge by another after completing photographic exposures. According to the invention, in the cases of either types thereof, a camera can be miniaturized in size and a scratch can be prevented.

In the invention, a constitutional example capable of functioning as a photographic unit is shown in FIG. 1.

FIG. 1 shows the cross-sectional view taken on the plane determined by the optical axis of a lens and the straight line in the film transportation direction intersecting the optical axis of the lens.

In FIG. 1, reference numeral 1 is a lens, 2 is a shutter, 3 is a silver halide light sensitive material -hereinafter referred simply to as a 'film'-, 4 is a photographic unit member, 5 is a light shielding film holder marking off the exposure area of a film, 6 is a cartridge holder, 7 is a lens holder applying a conical surface converging on a lens with a stray-radiation invading prevention process, and 8 is a cartridge for storing a film roll.

In the specification of the above-described photographic unit, there uses a spherical or aspherical fix-focussed single-component lens as a lens with a fixed aperture and a shutter having a fixed shutter speed with in the range of 50th to 1/200th second.

Next, the detailed descriptions of a photographic unit comprising a cartridge section and a camera section such as shown in FIG. 2.

In the invention, the above-mentioned cartridge section means a section where a light sensitive material is loaded into a cartridge comprising a film roll chamber storing therein a rolled unexposed light sensitive material, a take-up chamber for taking up an exposed light sensitive material, and a bridging member having an opening of not less than 400 $mm^2$ in area for connecting the above-mentioned two chambers to each other.

Taking the balance between the sizes of an image and a camera into consideration, the area of the above-mentioned opening is desirably within the range of 600 to 2,500 $mm^2$ and, preferably, 800 to 1,200 $mm^2$. In the invention, the area of the opening is substantially the effective area of an image.

The configuration of the opening is preferably to be in the rectangular form. Taking the shapes of the cameras used into consideration, the ratio of the longer side of the rectangle to the shorter side thereof is within the range of 1.2 to 2,0, desirably, 1.3 to 1.7 and, preferably, 1.4 to 1.6. When the raiot thereof is within the above-given range, the resulting images can be stable in visual psychology.

For the rolled light sensitive materials to be loaded in cartridges, the sizes thereof including the widths and lengths are preferable to meet the systems employed in the current market. It is preferable that the widths are to be 35 $\pm 1$ mm and the lengths are of the order of the lengths of the 135 size, 12ex, 20ex and 36ex films; provided, a rolled film can be made longer to be, for example, 72ex, 100ex and so forth, without making a camera size larger, by making the films more thinner.

The above-mentioned light sensitive materials are each preferable to be made adhered to a spool at least either one of a roll film chamber or a film take-up chamber.

For the materials of the cartridge section of a cartridge, plastics are preferable to be used, from the viewpoints of making a photographic unit lighter in weight, improving the simple operability, making the cost to be inexpensive, and recycling the materials.

The requirements for a preferable plastic-made cartridge are that (1) the light shielding property is to be excellent; (2) the photographic characteristics of a light sensitive material are to hardly be affected; and (3) the recycling is readily be performed. When the known plastic cartridges can satisfy the above-mentioned requirements, they can be used in the invention. The preferable examples of the plastic cartridges applicable thereto include, typically, those made of polystyrene, polypropylene, polyethylene, polyvinyl chloride, polymethyl methacrylate, polyethylene terephthalate, cellulose acetate ester and the copolymers thereof, each of which is provided with a light-shielding property by adding thereinto with carbon black or a pigment. For the purpose of improving the recycling efficiency, it is preferable that the spool of a cartridge is to be made of the same plastic as in the cartridge.

In the invention, it is preferable that a cartridge to be loaded a light sensitive material is to be applied with a light-shielding means, because the cartridge has an opening for making image exposures, including, for example, an elastic light-shielding member such as that disclosed in Japanese Patent O.P.I Publication No 60-120448/1985; a light shielding member such as that disclosed in Japanese Utility Model O.P.I. Publication No. 2-136247/1990; a pressure light-shielding member such as that disclosed in Japanese Utility Model O.P.I. Publication No. 2-136248/1990; a light-shielding paper such as those disclosed in Japanese Patent O.P.I. Publication Nos. 2-175441/1990 and 2-275442/1990; and a light-shielding paths such as those disclosed in Japanese Patent O.P.I. Publication No. 54-111832/1979 and Japanese Utility Model Examined Publication No. 46-30055/1971.

In the invention, it is preferable that a cartridge section and a camera section are to be correlatively detachable and, it is, therefore, preferable that at least either one of the two sections has a coupling member for detachment and attachment from one to the other section. It is, further, preferable that a stopper member is to be provided for preventing any detachment from any erroneous operation or any operations against one's will.

Figure 3:
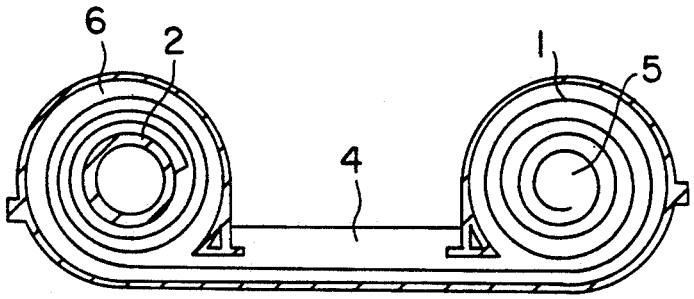
FIG. 3 is a cross-sectional view showing the cartridge of the invention.
Figure 4:
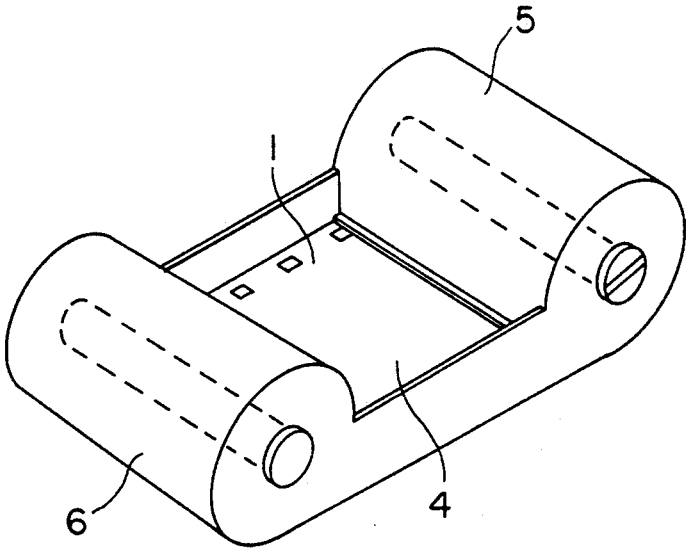
FIG. 4 is a perspective view of a cartridge.

In the invention, from the viewpoints of making a photographic unit lighter in weight, making an operation simpler, and making a recycling easier, it is preferable that a cartridge section can also perform the role of the back lid of a camera section when the cartridge section is attached to the camera section. The typical example of the above-mentioned preferable cases is shown in FIG. 3.

In the photographic units of the invention, a camera section is attached to a cartridge section and, preferably, one part or the whole of the outside of a photographic unit is to be covered by a covering member The above-mentioned measure is not only effective for absorbing any shock when a user drops a photographic unit so as to prevent a driving, optical and electrical systems from causing a trouble, but also effective for a valuable exposed image information from being damaged by separating a camera section from a cartridge section due to the erroneous operation or an operation against one's will.

The materials for the covering members are preferably made of a shock-absorbable materials including, for example, paper, sponge, rubber, leather and fabric.

The covering members are regardless of any configurations. However, the belt-shaped or the box-shaped thereof is preferably used. It is particularly preferable to use the box-shaped covering members which are each so made a hole as not to hinder the functions and operations for the lens, finder, strobe, shutter-button, and film take-up sections.

It is preferable that the photographic units of the invention are to be sealed up in a pack such as a plastic case or a moisture-proof bag, until they are used after they are manufactured. In the sealed packs, the relative humidity therein at a temperature of 25° C. is within the range of 30 to 70%, preferably 40 to 60% and particularly 45 to 55%. It is further preferable that the partial oxygen pressure is to be made lower than the atmospheric pressure by filling inert gasses.

The above-mentioned camera sections may be those newly manufactured and may also be a recycled camera sections which were already marketed, exposed, and separated from a cartridge section. For the purposes of effectively utilizing the resources, preventing environment from the pollution produced by waste materials, and making the recycling application easier, the above-mentioned camera sections are preferably reused or used in repetition. When making the reuse of the above-mentioned camera sections, they are preferable to be inspected if required in advance of the attachment thereof to a cartridge section, and the frequencies of the repetition uses are preferable to be recorded on the body of the camera section.

When a power source section, i.e., a battery, is provided to a camera section, the residual voltage of the battery is checked up and replaced if required so that the camera section can be reused. When the battery is rechargeable, the camera section can be reused upon recharging the battery. In the latter case, it is particularly preferable, because an environmental pollution produced by waste batteries can sharply be reduced.

The photographic units of the invention are preferable to have the whole volume within the range of 150 to 190 $cm^3$. When the photographic unit is regarded as a rectangular parallelopipedon, the second logest side out of the three sides is preferable to be within the range of 5.0 to 8 0 cm. The photographic unit satisfying the above-mentioned requirements can be right fit in the pocket of a shirt and, therefore, the portability thereof can be so excellent that the camera can not be slipped out of the pocket.

The silver halide emulsions of the invention contain each silver chloride having a proportion of not less than 10 mol %. The silver chloride contents is desirably not less than 50 mol % and, preferably, not less than 80 mol %.

Besides the silver chloride, silver bromide or silver iodide may desirably be contained as the silver halides, and the silver halide emulsion contains silver chlorobromide, silver chloroiodide, silver chloride and silver chloroiodobromide.

In the case where the silver halide emulsion of the invention comprises mixed crystals such as those of silver chlorobromide, silver chloroiodide or silver chloroiodobromide, it is desirable to locate silver bromide or silver iodide in the specific positions of the crystals of silver halide grains.

In the case where a silver halide emulsion of the invention is comprised of silver chlorobromide, it is desirable to locate silver bromide in the peak points each of the silver halide crystals or in the neighborhood of the peak points. Such a silver halide emulsion as mentioned above can be prepared by adsorbing a sensitizing dye or a inhibitor onto the crystals of silver chloride or silver chlorobromide grains and then by ripening them by adding a water-soluble bromide solution so as to make a halogen-substitution.

In the case that a silver halide emulsion of the invention is comprised of silver chloroiodobromide, it is desirable to locate silver iodide inside the grains of the silver halides.

A silver halide emulsion located silver iodide in the grains thereof can be prepared by depositing silver chloride or silver chlorobromide on core grains each containing silver iodide. When depositing silver chloride or silver chlorobromide, any well-known silver halide crystal growing processes such as a double-jet precipitation process and the Ostward ripening process may be used.

The core grains have each a silver iodide content of, desirably, not less than 10 mol %, preferably, not less than 15 mol % and, particularly, not less than 40 mol %.

The core grains may desirably be those of silver iodobromide.

The above-described silver halide emulsions may be prepared in any one of the processes disclosed in, for example, Japanese Patent O.P.I. Publication Nos. 64-6941/1989, 64-26839/1989, 1-121548/1989 and 1-138550/1989, respectively.

When the silver halide emulsion of the invention contains silver iodide, the silver iodide content of the whole emulsion is, desirably, not more than 20 mol %; preferably, not more than 12 mol %; and particularly, within the range of 0 to 5 mol %.

The silver halide emulsions of the invention may be either of the regular crystals such as those in the tetrahedral and octahedral forms or of the twinned crystals such as those in the tabular form. However, they are preferably cf the regular crystals and, the crystals are preferably to have the cubic configuration. The crystal configurations may be controlled by suitably selecting the pAg and pH values in the mixing course. The grains in the octahedral or tabular form may be prepared by growing the crystals in the presence of a sensitizing dye or an inhibitor each having an adsorbing property, as described in, for example, Japanese Patent O.P.I. Publication Nos. 58-11935/1983, 58-11936/1983, 58-11937/1983, 58-108528/1983, 62-163046/1987, 63-41845/1988 and 63-212932/1988.

The silver halide emulsions of the invention are to have an average grain size within the range of, desirably, 0.05 to 10 μm; preferably, 0.1 to 5 μm; and, particularly, 0.2 to 3 μm.

The silver halide emulsions of the invention may be used by mixing together with the other silver halide emulsions, provided, the effects of the invention cannot be spoiled. The silver halide emulsions of the invention are to be used in a proportion of, desirably, not less than 30 wt %; preferably, not less than 50 wt%; and, particularly, not less than 80 wt %.

In silver halide grains, the local presence of the halogen components can be confirmed in an X-ray diffraction method or in an X-ray microanalyzing method in which the chips of silver halide grains dispersed in a resin are investigated.

The silver halide emulsions of the invention are desirable to be monodispersive.

The term, 'grain size', herein means a diameter of the circular image having the same areas as the projective image has.

The above-mentioned grain sizes can be measured in the following manner, for example Subject grains are dispersed on a flat sample table so as not to be superposed together and they are photographed upon magnifying them 10000 to 50000 times through an electron microscope and then printed. On the resulting print, the diameters of the grains or the areas of the resulting projective grain images are practically measured, provided, the numbers of the subject grains are to be not less than 1000 at random.

In the highly monodispersive emulsions particularly desirable for the invention, the distribution degrees are defined by the following equation;

$$\frac{\text{Standard grain size deviation}}{\text{Average grain size}} \times 100 = \text{distribution degree (\%)}$$

The above-mentioned highly monodispersive emulsions have each a grain size distribution of not higher than 20% and, desirably, not higher than 15%.

A silver halide color photographic light sensitive material can be prepared by making use of the silver halide emulsions of the invention.

In the invention, silver halide emulsions are to be used after completing both physical and chemical ripening steps and a spectral sensitizing step. In the above-mentioned steps, the additives applicable thereto are given in Research Disclosure Nos. 17643, 18716 and 308119, -hereinafter abbreviated to as RD17643, RD18716 and RD308119, respectively.

The following table shows where they are given:

| [Additive] | [Page in RD308119] | [RD17643] | [RD18716] |
|---|---|---|---|
| Chemical sensitizer | 996 III-A | 23 | 648 |
| Spectral sensitizer | 996 IV-A-A, B, C, D, H, H, I, J | 23-24 | 648-9 |
| Super sensitizer | 996 IV-A-E, J | 23-24 | 648-9 |
| Antifoggant | 998 VI | 24-25 | 649 |
| Stabilizer | 998 VI | 24-25 | 649 |

The well-known photographic additives applicable to the invention are also given in the above-mentioned Research Disclosures. The following table shows where they are given:

| [Additive] | [Page in RD308119] | [RD17643] | [RD18716] |
|---|---|---|---|
| Color contamination preventive | 1002 VII-I | 25 | 650 |
| Dye image stabilizer | 1001 VII-J | 25 | |
| Whitening agent | 988 V | 24 | |
| UV absorbent | 1003 VIII C, XIII C | 25-26 | |
| Light absorbent | 1003 VIII | 25-26 | |
| Light diffuser | 1003 VIII | | |
| Filtering dye | 1003 VIII | 25-26 | |
| Binder | 1003 IX | 26 | 651 |
| Antistatic agent | 1006 XIII | 27 | 650 |
| Layer hardener | 1004 X | 26 | 651 |
| Plasticizer | 1006 XII | 27 | 650 |
| Lubricant | 1006 XII | 27 | 650 |
| Activator coating aid | 1005 XI | 26-27 | 650 |
| Matting agent | 1007 X VI | | |
| Developing agent contained in a light sensitive material | 1011 XX-B | | |

A variety of couplers can be used in the invention. The concrete examples thereof are given in the above-mentioned Research Disclosures. The following table shows where they are given;

| [Coupler] | [Page in RD308119] | [RD17643] | [RD18716] |
|---|---|---|---|
| Yellow coupler | 1001 VII-D | | VII C-G |
| Magenta coupler | 1001 VII-D | | VII C-G |
| | | | VII C-G |
| Cyan coupler | 1001 VII-D | | VII C-G |
| DIR coupler | 1001 VII-F | | VII F |
| BAR coupler | 1002 VII-F | | |
| Other useful residual group-releasing coupler | 1001 VII-F | | |
| Alkali-soluble coupler | 1001 VII-E | | |

The additives applicable to the invention can be added in the dispersing methods such as that described in RD308119 XIV.

In the invention, it is allowed to use the supports described in p. 28 of the above-given RD17643, pp. 647-8 of RD18716 and XIX of RD308119.

To the light sensitive materials of the invention, the auxiliary layers such as a filtering layer and an interlayer such as those described in the RD308119 VII-K may be provided.

The light sensitive materials of the invention may have a variety of layer arrangements including a normal, inverted or unit layer arrangement such as those described in the RD308119 VII-K.

The invention can be applied to a variety of light sensitive materials including, typically, a color negative film for general or cinematographic use, a color reversal film for slide or TV use, and a color positive film.

The light sensitive materials of the invention can be developed in the ordinary processes described in pp. 28-29 of RD17643, p. 647 of RD18716 and X VII of RD308119.

EXAMPLES

Some concrete examples of the invention will now be detailed below.

In the every example given below, the amounts of the materials added to the silver halide light sensitive materials are expressed in terms of grams per sq. meter, unless otherwise expressly stated. The amounts of silver halide and colloidal silver are indicated by converting them into the amounts of silver, and the amounts of the sensitizing dyes are indicated in terms of mol numbers per mol of silver.

EXAMPLE 1

A multilayered color photographic light sensitive material sample 101 was prepared in the manner that each of the layers having the following compositions were formed on a 120 μm thick triacetyl cellulose film support, in order from the support side.

| Sample 101 for comparison | |
|---|---|
| Layer 1: An antihalation layer, HC | |
| Black colloidal silver | 0.15 |
| UV absorbent, UV-1 | 0.20 |
| Colored cyan coupler, CC-1 | 0.02 |
| High boiling solvent, Oil-1 | 0.20 |
| High boiling solvent, Oil-2 | 0.20 |
| Gelatin | 1.6 |
| Layer 2: An interlayer, IL-1 | 1.3 |
| Gelatin | |
| Layer 3: A low speed red-sensitive emulsion layer, R-L | |

-continued

| Sample 101 for comparison | |
|---|---|
| Silver iodobromide emulsion, Em-1 | 0.4 |
| Silver iodobromide emulsion, Em-2 | 0.3 |
| Sensitizing dye, S-1 | $3.2 \times 10^{-4}$ mols/mol of silver |
| Sensitizing dye, S-2 | $3.2 \times 10^{-4}$ mols/mol of silver |
| Sensitizing dye, S-3 | $0.2 \times 10^{-4}$ mols/mol of silver |
| Cyan coupler, C-1 | 0.50 |
| Cyan coupler, C-2 | 0.13 |
| Colored cyan coupler, CC-1 | 0.07 |
| DIR compound, D-1 | 0.006 |
| DIR compound, D-2 | 0.01 |
| High boiling solvent, Oil-1 | 0.55 |
| Gelatin | 1.0 |
| Layer 4: A high speed red-sensitive emulsion layer, R-H | |
| Silver iodobromide emulsion, Em-3 | 0.9 |
| Sensitizing dye, S-1 | $1.7 \times 10^{-4}$ mols/mol of silver |
| Sensitizing dye, S-2 | $1.6 \times 10^{-4}$ mols/mol of silver |
| Sensitizing dye, S-3 | $0.1 \times 10^{-4}$ mols/mol of silver |
| Cyan coupler, C-2 | 0.23 |
| Colored cyan coupler, CC-1 | 0.03 |
| DIR compound, D-2 | 0.02 |
| High boiling solvent, Oil-1 | 0.25 |
| Gelatin | 1.0 |
| Layer 5: An interlayer, IL-2 | 0.8 |
| Gelatin | |
| Layer 6: A low speed green-sensitive emulsion layer, G-L | |
| Silver iodobromide emulsion, Em-1 | 0.6 |
| Silver iodobromide emulsion, Em-2 | 0.2 |
| Sensitizing dye, S-4 | $6.7 \times 10^{-4}$ mols/mol of silver |
| Sensitizing dye, S-5 | $0.8 \times 10^{-4}$ mols/mol of silver |
| Magenta coupler, M-1 | 0.17 |
| Magenta coupler, M-2 | 0.43 |
| Colored magenta coupler, CM-1 | 0.10 |
| DIR compound, D-3 | 0.02 |
| High boiling solvent, Oil-2 | 0.70 |
| Gelatin | 1.0 |
| Layer 7: A high speed green-sensitive emulsion layer, G-H | |
| Silver iodobromide emulsion, Em-3 | 0.9 |
| Sensitizing dye, S-6 | $1.1 \times 10^{-4}$ mols/mol of silver |
| Sensitizing dye, S-7 | $2.0 \times 10^{-4}$ mols/mol of silver |
| Sensitizing dye, S-8 | $0.3 \times 10^{-4}$ mols/mol of silver |
| Magenta coupler, M-1 | 0.03 |
| Magenta coupler, M-2 | 0.13 |
| Colored magenta coupler, CM-1 | 0.04 |
| DIR compound, D-3 | 0.004 |
| High boiling solvent, Oil-2 | 0.35 |
| Gelatin | 1.0 |
| Layer 8: A yellow filtering layer, YC | |
| Yellow colloidal silver | 0.1 |
| Additive, HS-1 | 0.07 |
| Additive, HS-2 | 0.07 |
| Additive, SC-1 | 0.12 |
| High boiling solvent, Oil-2 | 0.15 |
| Gelatin | 1.0 |
| Layer 9: A low speed blue-sensitive emulsion layer, B-L | |
| Silver iodobromide emulsion, Em-1 | 0.25 |
| Silver iodobromide emulsion, Em-2 | 0.25 |
| Sensitizing dye, S-9 | $5.8 \times 10^{-4}$ mols/mol of silver |
| Yellow coupler, Y-1 | 0.60 |
| Yellow coupler, Y-2 | 0.32 |
| DIR compound, D-1 | 0.003 |
| DIR compound, D-2 | 0.006 |
| High boiling solvent, Oil-2 | 0.18 |
| Gelatin | 1.3 |
| Layer 10: A high speed blue-sensitive emulsion layer, B-H | |
| Silver iodobromide emulsion, Em-4 | 0.5 |
| Sensitizing dye, S-10 | $3.0 \times 10^{-4}$ mols/mol of silver |
| Sensitizing dye, S-11 | $1.2 \times 10^{-4}$ mols/mol of silver |
| Yellow coupler, Y-1 | 0.18 |
| Yellow coupler, Y-2 | 0.10 |
| High boiling solvent, Oil-2 | 0.05 |

-continued

| Sample 101 for comparison | |
|---|---|
| Gelatin | 1.0 |
| Layer 11: The first protective layer, PRO-1 | |
| Silver iodobromide emulsion, Em-5 | 0.3 |
| UV absorbent, UV-1 | 0.07 |
| UV absorbent, UV-1 | 0.1 |
| Additive, HS-1 | 0.2 |
| Additive, HS-2 | 0.1 |
| High boiling solvent, Oil-1 | 0.07 |
| High boiling solvent, Oil-3 | 0.07 |
| Gelatin | 0.8 |
| Layer 12: The second protective layer, PRO-2 | |
| Alkali-soluble matting agent, the average particle size: 2 μm | 0.13 |
| Polymethyl methacrylate, the average particle size: 3 μm | 0.02 |
| Gelatin | 0.5 |

Besides the above-given compositions, a coating aid SU-2, a dispersing aid SU-1, layer hardeners H-1 and H-2, and dyes AI-1 and AI-2 were suitably added into each of the layers.

The emulsions used in the above-mentioned sample were those shown below, and every one of them was the monodispersive core-shell emulsion of the internal high iodide-containing type.

Em-1: Average AgI content: 7.5 mol %; Octahedral grains; Average grain size: 0.55 μm; Monodispersion degree: 14%; and so forth on;

Em-2: Average AgI content: 2.5 mol %; Octahedral grains; Average grain size: 0.36 μm; Monodispersion degree: 14%;

Em-3: Average AgI content: 8.0 mol %; Octahedral grains; Average grain size: 0.84 μm; Monodispersion degree: 12%;

Em-4: Average AgI content: 8.5 mol %; Octahedral grains; Average grain size: 1.02 μm; Monodispersion degree: 12%; and Em-5: Average AgI content: 2.0 mol %; Octahedral grains; Average grain size: 0.08 μm; Monodispersion degree: 12%.

C-1
|
H-2

SU-1 -Alkanol XC-
|
AI-2

Next, samples 102 through 106 were each prepared by making use of the emulsions shown in Table-1 in place of emulsions Em-1 through Em-4 each used in sample 101.

The resulting samples 101 through 106 were each cut into 35 mm in width and 120 cm in length, and each of the sample pieces was wound round a spool having a diameter of 11.0 mm so as to be a roll having a diameter of 18.0 mm. The resulting number of turns was 24.

$$\frac{(\text{a roll diameter} - \text{a spool diameter})}{(\text{a number of turns} \times 2)} - \text{the thickness of a base was 26 } \mu\text{m.}$$

After the resulting rolled samples were each stored for 3 days at ordinary temperature of 25° C. and ordinary humidity of 30% RH, they were unwound and exposed to light uniformly to have a color density of 1.0, and were then developed as shown below.

In the color developments, sample 101 was made for 3 min. 15 sec., and the other samples each, for 2 min., respectively.

| Processing step | Processing time | Processing temperature | Processing* replenishment |
|---|---|---|---|
| Color developing | As aforestated | 38° C. | 540 ml |
| Bleaching | 45 sec. | 38° C. | 155 ml |
| Fixing | 1 min 45 sec. | 38° C. | 500 ml |
| Stabilizing | 90 sec. | 38° C. | 775 ml |
| Drying | 1 min. | 40–70° C. | — |

*Amount of replenishment is expressed by an amount per sq. meter of a subject light sensitive material.

The stabilizing steps were carried out in a three-bath counter-current processing system. The replenishments were made to the final bath of the stabilizer and the overflows were flown into the bath preceedent to the above-mentioned final bath.

A part -275 ml/m$^2$- of the overflows from the stabilizing bath following the fixing bath was flown into the fixing bath.

The compositions of the color developer used therein were as follows:

| | |
|---|---|
| Potassium carbonate | 30 g |
| Sodium hydrogencarbonate | 2.7 g |
| Potassium sulfite | 2.8 g |
| Sodium bromide | 1.3 g |
| Hydroxylamine sulfate | 3.2 g |
| Sodium chloride | 0.6 g |
| 4-amino-3-methyl-N-ethyl-N-(β-hydroxylethyl)aniline sulfate | 4.6 g |
| Diethylenetriamine pentaacetate | 3.0 g |
| Potassium hydroxide | 1.3 g |
| Add water to make | 1 liter |
| Adjust pH with potassium hydroxide or a 20% sulfuric acid solution to be | pH = 10.01 |

The compositions of the color developing replenisher used therein were as follows:

| | |
|---|---|
| Potassium carbonate | 40 g |
| Sodium hydrogen carbonate | 3 g |
| Potassium sulfite | 7 g |
| Sodium bromide | 0.5 g |
| Hydroxylamine sulfate | 3.2 g |
| 4-amino-3-methyl-N-ethyl-N-(β-hydroxylethyl)aniline sulfate | 6.0 g |
| Diethylenetriamine pentaacetate | 3.0 g |
| Potassium hydroxide | 2 g |
| Add water to make | 1 liter |
| Adjust pH with potassium hydoxide or a 20% sulfuric acid solution to be | pH = 10.12 |

The compositions of the bleaching solution used therein were as follows:

| | |
|---|---|
| Ferric ammonium 1,3-diaminopropane-tetraacetate | 0.35 mols |
| Disodium ethylenediaminetetraacetate | 2 g |
| Ammonium bromide | 150 g |
| Glacial acetic acid | 40 ml |
| Ammonium nitrate | 40 g |
| Add water to make | 1 liter |
| Adjust pH with aqueous ammonia or glacial acetic acid to be | pH = 4.5 |

The compositions of the bleaching replenisher used therein were as follows:

| | |
|---|---|
| Ferric ammonium 1,3-diaminopropane-tetraacetate | 0.40 mols |
| Disodium ethylene diamine tetraacetate | 2 g |
| Ammonium bromide | 170 g |
| Ammonium nitrate | 50 g |
| Glacial acetic acid | 61 ml |
| Add water to make | 1 liter |
| Adjust pH with aqueous ammonia or glacial acetic acid to be | pH = 3.5 |
| Control suitably the pH of the bleaching solution constant in the bleaching bath. | |

The compositions of the fixer and the fixing replenisher each used therein were as follows:

| | |
|---|---|
| Ammonium thiosulfate | 100 g |
| Ammonium thiocyanate | 150 g |
| Sodium bisulfite, anhydrous | 20 g |
| Sodium metabisulfite | 4.0 g |
| Disodium ethylenediaminetetraacetate | 1.0 g |
| Add water to make | 1 liter |
| Adjust pH with glacial acid and aqueous ammonia to be | pH = 6.5 |

The stabilizer and the stabilizing replenisher each used therein were as follows:

| | |
|---|---|
| 1,2-benzisothiazoline-3-one | 0.1 g |
| $C_8H_{17}$—$C_6H_4$—(—$CH_2CH_2O$—)$_{10}$—H <in a 50% solution> | 2.0 ml |
| Hexamethylenetetramine | 0.2 g |
| Hexahydro-1,3,5-trifluoro(2-hydroxyethyl)-5-triazine | 0.3 g |
| Add water to make | 1 liter |
| Adjust pH with potassium hydroxide and a 50% sulfuric acid solution to be | pH = 7.0 |

TABLE 1

| | Sample 101 | Sample 102 | Sample 103 | Sample 104 | Sample 105 | Sample 106 |
|---|---|---|---|---|---|---|
| Em-1 | | | | | | |
| Composition | AgBr 0.925<br>I 0.075 | AgBr 0.01<br>Cl 0.99 | AgCl<br>Cl 0.3 | AgBr 0.7<br>Cl 0.75<br>I 0.10 | AgBr 0.15<br>Cl 0.75<br>I 0.10 | AgCl |
| Configuration | Octahedron | Cube | Cube | Cube | Cube | Octahedron |
| Ave. grain size | 0.55 μm | 0.46 μm** | 0.46 μm** | 0.46 μm** | 0.46 μm** | 0.57 μm* |
| Monodispersion degree | 14% | 12% | 10% | 10% | 12% | 14% |
| Em-2 | | | | | | |
| Composition | AgBr 0.975<br>I 0.025 | AgBr 0.01<br>Cl 0.99 | AgCl | AgBr 0.7<br>I 0.3 | AgBr 0.15<br>Cl 0.75<br>I 0.10 | AgCl |
| Configuration | Tetradecahedron | Cube | Cube | Cube | Cube | Octahedron |
| Ave. grain size | 0.36 μm* | 0.30 μm** | 0.30 μm** | 0.30 μm** | 0.30 μm** | 0.38 μm* |

TABLE 1-continued

| | Sample 101 | Sample 102 | Sample 103 | Sample 104 | Sample 105 | Sample 106 |
|---|---|---|---|---|---|---|
| Monodispersion degree | 14% | 12% | 11% | 11% | 13% | 14% |
| Em-3 | | | | | | |
| Composition | AgBr 0.92<br>I 0.08 | AgBr 0.01<br>Cl 0.99 | AgCl | AgBr 0.7<br>Cl 0.3 | AgBr 0.15<br>Cl 0.75<br>I 0.10 | AgCl |
| Configuration | Octahedron | Cube | Cube | Cube | Cube | Cube |
| Ave. grain size | 0.84 μm* | 0.70 μm** | 0.70 μm** | 0.30 μm** | 0.30 μm** | 0.86 μm* |
| Monodispersion degree | 12% | 11% | 9% | 9% | 12% | 12% |
| Em-4 | | | | | | |
| Composition | AgBr 0.915<br>I 0.085 | AgBr 0.01<br>Cl 0.99 | AgCl | AgBr 0.7<br>Cl 0.3 | AgBr 0.15<br>Cl 0.75<br>I 0.10 | AgCl |
| Configuration | Octahedron | Cube | Cube | Cube | Cube | Cube |
| Ave. grain size | 1.02 μm* | 0.85 μm** | 0.85 μm** | 0.85 μm** | 0.85 μm** | 1.05 μm* |
| Monodispersion degree | 12% | 11% | 9% | 9% | 12% | 12% |

*A diameter of the circle having an area equivalent to that of the projective image
**Length of a side The density uniformity of the resulting developed samples were examined and the presence of the areas where the densities were lowered were also confirmed. The results thereof are shown in Table-2 given below.

TABLE 2

| Sample No. | Presence of density lowered area |
|---|---|
| 101 for Comparison | Yes |
| 102 for Invention | Nil |
| 103 for Invention | Nil |
| 104 for Invention | Nil |
| 105 for Invention | Nil |
| 106 for Invention | Nil |

EXAMPLE 2

Samples 101–106 prepared in Example 1 were each cut into 35 mm in width and 120 mm in length and each of them was so wound round without using spools as to be 15 mm in diameter of the roll. The resulting rolls were stored in photographic units having an exposure function shown in FIG. 1, respectively. The films stored in the respective photographic units were each exposed to light and they were taken up in cartridges. Thereafter, the films taken out of the cartridges were each developed in the same manner as in Example 1 and were then checked up on whether any scratch troubles -a linear shaped color production- were produced or not on the films. The results thereof are shown in Table-3 given below.

TABLE 3

| Sample No. | Presence of scratch trouble |
|---|---|
| 101 for Comparison | D |
| 102 for Invention | Nil A |
| 103 for Invention | Nil A |
| 104 for Invention | Nil A |
| 105 for Invention | Nil A |
| 106 for Invention | Nil A |

In the Table-3, the grade of scratch trouble is shown according to the following standard:

| Grade | Number of scratch troubles per film |
|---|---|
| A | 0–3 |

-continued

| Grade | Number of scratch troubles per film |
|---|---|
| B | 4–8 |
| C | 9–15 |
| D | over 16 |

It can be proved in the invention that any scratch troubles can hardly be produced.

The invention can provide a roll-shaped and small-sized silver halide color photographic light sensitive material capable of displaying an excellent pressure resistance characteristics and inhibiting any scratch trouble from occuring, and the photographic units thereof.

What is claimed is:

1. A light-sensitive silver halide color photographic material comprising a base film having provided thereon at least one silver halide photographic emulsion layer, said material being stored in a roll within a film cartridge, wherein;

$$\frac{(\text{a roll diameter} - \text{a spool diameter})}{(\text{a number of turns} \times 2)} - \text{a thickness of the base film}$$

is 20 to 60 μm, wherein at least one silver halide emulsion layer contains a silver halide emulsion containing silver chloride in a proportion of not less than 10 mol %, and a grain size distribution in said silver halide emulsion is not greater than 15%.

2. A light-sensitive silver halide color photographic material according to claim 1, wherein the silver halide emulsion containing silver chrolide in a proportion of not less than 50 mol %.

3. A light-sensitive halide color photographic material according to claim 1, wherein the value is 25 to 50 μm.

4. A light-sensitive silver halide color photographic material according to claim 1, wherein a thickness of the base film is 50 to 100 μm.

5. A light-sensitive silver halide color photographic material according to claim 1, wherein the silver halide emulsion containing silver chrolide in a proportion of not less than 50 mol %.

6. A light-sensitive silver halide color photographic material according to claim 1, wherein the silver halide emulsion containing silver chrolide in a proportion of not less than 80 mol %.

7. A light-sensitive silver halide color photographic material according to claim 1, wherein the silver halide emulsion is silver chroloiodobromide having a silver iodide content of not more than 12 mol %.

8. A light-sensitive silver halide color photographic material according to claim 7 wherein the silver halide emulsion is silver chroloiodobromide having a silver iodide content of 0 to 5 mol %.

9. A light-sensitive silver halide color photographic material according to claim 1, wherein the silver halide emulsion is a monodispersed silver halide emulsion.

10. A light-sensitive silver halide color photographic material comprising a film base having provided thereon at least one silver halide photographic emulsion layer and being stored in a roll within a film cartridge, wherein;

$$\frac{(\text{a roll diameter} - \text{a spool diameter})}{(\text{a number of turns} \times 2)} - \text{a thickness of the base film}$$

is 25 to 50 μm, wherein at least one silver halide emulsion layer contains a monodispersed silver halide emulsion containing silver chloride in a proportion of not less than 5 mol %, said silver halide emulsion has a grain size distribution of not more than 15%; and the thickness of said base film is 50 to 100 μm.

* * * * *